United States Patent [19]

Becker et al.

[11] Patent Number: 4,606,410

[45] Date of Patent: Aug. 19, 1986

[54] SUBSURFACE SAFETY SYSTEM

[75] Inventors: Billy G. Becker; Charles V. Swafford, both of Ventura, Calif.

[73] Assignee: BST Lift Systems, Inc., Ventura, Calif.

[21] Appl. No.: 677,396

[22] Filed: Dec. 3, 1984

Related U.S. Application Data

[62] Division of Ser. No. 482,584, Apr. 6, 1983, Pat. No. 4,508,166.

[51] Int. Cl.[4] ..... E21B 23/03

[52] U.S. Cl. ..... 166/313; 166/117.5; 166/377; 166/378; 166/386

[58] Field of Search ..... 166/117.5, 117.6, 385, 166/386, 381, 378, 377, 242, 153, 156, 313, 383; 29/213, 213 E; 137/315, 316

[56] References Cited

U.S. PATENT DOCUMENTS

| | | | |
|---|---|---|---|
| Re. 31,155 | 2/1983 | Crocker | 166/117.5 |
| 2,492,079 | 12/1949 | Wiley | 166/117.5 |
| 2,923,357 | 2/1960 | Daffin | 166/242 |
| 3,171,483 | 3/1965 | Fredd | 166/313 |
| 3,268,006 | 8/1966 | Hayes | 166/117.5 |
| 3,799,259 | 3/1974 | Dinning | 166/117.5 |
| 4,074,762 | 2/1978 | Parker et al. | 166/385 X |

*Primary Examiner*—James A. Leppink
*Assistant Examiner*—Hoang C. Dang
*Attorney, Agent, or Firm*—Hubbard, Thurman, Turner & Tucker

[57] ABSTRACT

Disclosed is a method of inserting and removing tubular valves into and from the secondary bore of a mandral having a main bore and a laterally offset secondary bore. The method includes the steps of positioning a whipstock plug having a sloping upper surface in the main bore and orienting the whipstock plug such that the upper surface slopes toward the secondary bore. The valves are removed by deflecting a retrieving tool off the upper surface of the whipstock plug to engage and remove the tubular valve from the secondary bore. The valves are inserted by deflecting the valve off the upper surface and into the secondary bore. After removal or insertion of a valve, the whipstock plug is removed from the main bore.

4 Claims, 11 Drawing Figures

SUBSURFACE SAFETY SYSTEM

This is a division of application Ser. No. 482,584, filed Apr. 6, 1983, now U.S. Pat. No. 4,508,166, issued Apr. 2, 1985.

BACKGROUND OF THE INVENTION

A. Field of the Invention

The present invention relates generally to systems for controlling the flow of fluids in wells, and more particularly, to a subsurface system for controlling the flow of fluids in the tubing and the annulus.

B. Description of the Prior Art

Surface controlled subsurface safety systems are used for shutting in wellbores below the wellhead. They all include a valve inserted in the tubing string, which is normally held open, but which closes upon loss of a pressure signal from the surface. The valves may be either included as part of the tubing or insertable into or removable from the tubing by wireline. Valves that are included as a part of the string are commonly referred to as tubing-retrievable subsurface safety valves and include, for example, Johnston-Macco "TF Surface-Controlled Tubing-Retrievable SSSV" as shown at page 4999 of the 1982–83 Composite Catalog or Baker Packers "FVL or FVH Tubing Retrievable Safety Valves", as shown at pages 912–913 of the 1982–83 Composite Catalog. The valves that are insertable into or removable from the tubing by wireline are commonly referred to as wireline retrievable subsurface safety valves and include, for example, Johnston-Macco "WF Surface-Controlled Wireline-Retrievable SSSV" as shown at page 5000 of the 1982–83 Composite Catalog or Baker Packers "BFV Wireline Retrievable Safety Valve" as shown at pages 938–39 of the 1982–83 Composite Catalog. A packer is always set between the tubing and the casing so that, normally, when the safety valve closes, the entire well i.e., tubing and annulus, is sealed.

In some situations, however, it is necessary or desirable to vent the casing or annulus. Venting the annulus is particularly desirable in situations where the formation pressure is very low. When the formation pressure is low, it is necessary to reduce as much as possible the bottom hole pressure so as not to impede the production from the formation. More specifically, the rate of production from the formation is governed in large part by the differential between the formation pressure and bottom hole pressure. As the oil flows out of the formation and into the annulus, gas often comes out of the oil and builds up in the annulus. If the annulus is not vented, then the gas pressure increases the annulus pressure and thereby decreases the differential between formation pressure and bottom hole pressure.

Presently, there exist subsurface safety systems that allow casing or annulus pressure to be vented. Typically, such systems include a combination of a tubing safety valve with an annulus safety valve. More specifically, the presently existing systems include a combination tubing safety valve and vented packer with means for closing the packer vent. When the tubing safety valve is signaled to close, the vent also closes. One example of an existing system is disclosed in U.S. Pat. No. 4,049,052. Additional examples are disclosed in U.S. Pat. No. 3,035,642; U.S. Pat. No. 3,313,350; U.S. Pat. No. 3,252,476; U.S. Pat. No. 3,045,755; U.S. Pat. No. 3,156,300; and U.S. Pat. No. 3,299,955.

There are a number of shortcomings in the presently existing annulus subsurface safety systems. The most serious shortcoming is in that all prior annulus venting systems provide a restricted flow passage that may allow full venting on the case. Additionally, in most systems, the annulus valve is exterior of the tubing and inaccessible from the surface. In such systems, while the tubing subsurface safety valve may be replaced by a wireline retrievable valve, the annulus valve cannot be serviced or replaced without pulling the tubing.

It is therefore an object of the present invention to provide a subsurface safety system that overcomes the shortcomings of the prior art. More specifically, it is an object of the present invention to provide an annulus subsurface safety system that allows full bore venting of the annulus.

It is a further object of the present invention to provide an annulus subsurface safety system wherein both the tubing safety valve and annulus safety valve are independently operable full bore tubing retrievable subsurface safety valves or wireline retrievable subsurface safety valves, both of which may be accessed and serviced from the surface.

It is a further object of the present invention to provide an annulus subsurface safety system which may be serviced in wells with highly deviated angles and heavy, viscous, low gravity crude oil.

SUMMARY OF THE INVENTION

Briefly stated, the foregoing and other objects are accomplished by the subsurface safety system of the present invention. The system includes a primary production tubing which extends from the producing zone to the surface and which includes an entry mandrel having a full bore outlet connected with the portion of the primary tubing which extends to the surface and a full bore primary inlet connected to that portion of the primary tubing which extends down the hole to the formation. The system further includes a full bore secondary vent tubing which is connected to a full bore secondary inlet in the entry mandrel spaced laterally apart from the primary inlet. The secondary vent tubing extends down the hole generally parallel to the primary production tubing and includes an open lower end positioned in the annulus above the producing formation. A dual packer is provided in the system between the entry mandrel and the lower opened end of the secondary vent tubing. The dual packer surrounds both the primary and secondary tubings and is adapted to seal with the casing and pack off the annulus. The upper end of the secondary tubing is normally closed by a removable plug, but a vent is provided in the secondary tubing, thereby to allow annulus pressure to by-pass the dual packer. Means are provided in the entry mandrel for normally deflecting or diverting well tools toward the primary inlet and primary tubing.

Tubing retrievable subsurface safety valves are provided in both the primary and secondary tubings. The subsurface safety valve in the primary tubing may be positioned above, but preferably is positioned below the entry mandrel. The subsurface safety valve in the secondary tubing is positioned between the open lower end and the vent. In normal operation, both subsurface safety valves are open and oil flows upwardly through the primary tubing and entry mandrel to the surface. Gas from the formation enters the secondary tubing below the dual packer and exits the secondary tubing through the vent above the dual packer. When the subsurface safety valves are closed, the flows of oil through the primary tubing and gas through the secondary tubing are prevented.

If it is desired to service or replace the subsurface safety valve in the secondary tubing with a wireline retrievable subsurface safety valve, a whipstock plug is first set in the primary inlet of the entry mandrel. The whipstock plug includes a sloping upper surface that is aligned to divert well tools toward the secondary inlet of the entry mandrel. After setting the whipstock plug, the removable plug in the secondary tubing is removed thereby giving access to the secondary tubing for servicing or other operations. When the servicing or other operation is complete, the removable plug in the secondary tubing is replaced and the whipstock plug is removed, thereby to put the system back in normal operation.

DESCRIPTION OF THE PREFERRED EMBODIMENT

Figure 1:
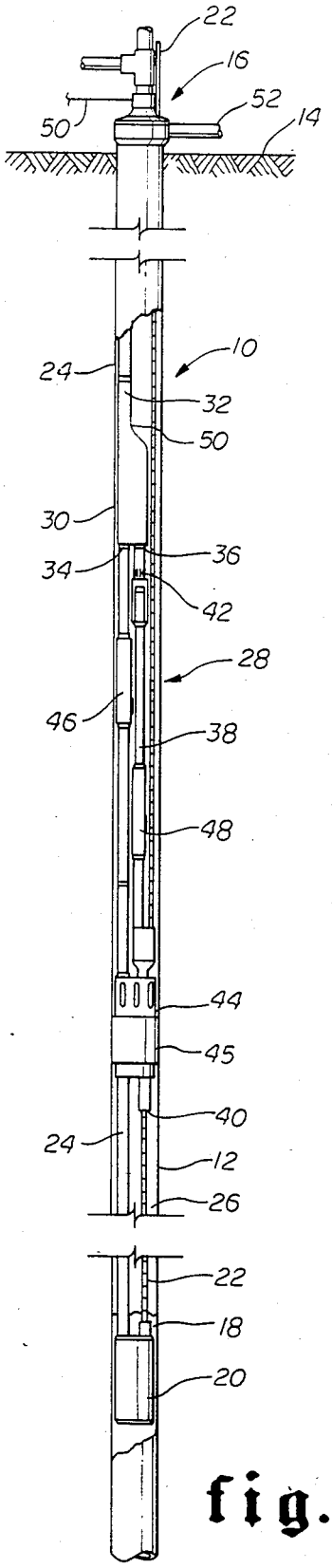
FIG. 1 is a schematic view of a well utilizing the subsurface safety system of the present invention.

Referring now to the drawings and first to FIG. 1, a well is designated generally by the numeral 10. Well 10 includes a casing 12, which extends downwardly from the surface and which is connected to a well head, which is designated generally by the numeral 16. A quantity of oil 18 is shown at the bottom of casing 12. Oil 18 is lifted to surface 14 by means of a preferably electrically operated submersible pump 20. Submersible pump 20 is supplied with electricity through an electrical cable 22 from surface 14. Those skilled in the art recognize the existence of non-electrical subsurface pumps, as for example those operated hydraulically. The oil lifted by submersible pump 20 is carried to the surface through a primary tubing string 24. The space surrounding primary tubing string 24 within casing 12 is referred to as the annulus, which is designated by the numeral 26.

The subsurface safety system of the present invention is designated generally by the numeral 28. Subsurface safety system 28 includes an entry mandrel 30 interconnected in primary string 24 at an outlet 32 and a full bore primary inlet 34. Entry mandrel 30 also includes a full bore secondary inlet 36 to which is connected a full bore secondary or vent tubing 38. Secondary tubing 38 has a gas inlet at an open lower end 40 and a plurality of gas outlet vents 42 below secondary inlet 36. The surface area of vents 42 is preferably greater than the inside area of tubing 38 so that vents 42 provide full bore venting. As will be discussed in detail hereinafter, secondary inlet 36 is normally plugged so that entry mandrel 30 and secondary tubing 38 do not normally communicate with each other.

Subsurface safety system 28 includes a dual packer 44 of the type well known in the art and readily available in commerce. Packer 44 is positioned about primary tubing 24 and secondary tubing 38 above open lower end 40 of secondary tubing 38. Packer 44 includes a packer element 45 which is expansible into contact with casing 12. Thus, packer 44 isolates the annulus there below from the annulus there above and the only communication across packer 44 is through primary tubing 24 and secondary tubing 38.

Subsurface safety system 28 also includes a primary tubing retrievable subsurface safety valve 46 in primary tubing 24 and a secondary subsurface tubing retrievable safety valve 48 in secondary tubing 38. Primary subsurface safety valve 46 and secondary subsurface safety valve 48 are held in a normally open position by a hydraulic controll system supplied from the surface through a conduit 50 thereby to allow for the flow of oil to the surface through primary tubing 24 and the flow of gas from opened lower end 40 of secondary tubing 38 to vents 42, respectively. When it is desired to shut in well 10, primary subsurface safety valve 46 and secondary subsurface safety valve 48 are signaled to close, thereby preventing flow through primary tubing 24 and secondary tubing 38, respectively. With the respective subsurface safety valves closed, well 10 below packer 44 is effectively shut in. While secondary subsurface safety valve 48 is necessarily positioned between open lower end 40 of secondary tubing 38 and vents 42 and thus below entry mandrel 30, primary subsurface safety valve may be positioned anywhere in primary tubing 24 between surface 14 and submersible pump 20. However, primary subsurface safety valve 46 is preferably positioned in primary tubing string 24 below entry mandrel 30, so that wireline operations in secondary tubing 38 do not need to be conducted through primary subsurface safety valve 46.

In normal operations, with secondary subsurface safety valve 48 open, gas in annulus 26 below packer 44 is vented across packer 44 through secondary tubing 38. More specifically, gas enters lower end 40 of secondary tubing 38 and exits secondary tubing 38 at vents 42 into the annulus above packer 44 to be vented or removed at surface 14 through a gas conduit 52.

Figure 2A:
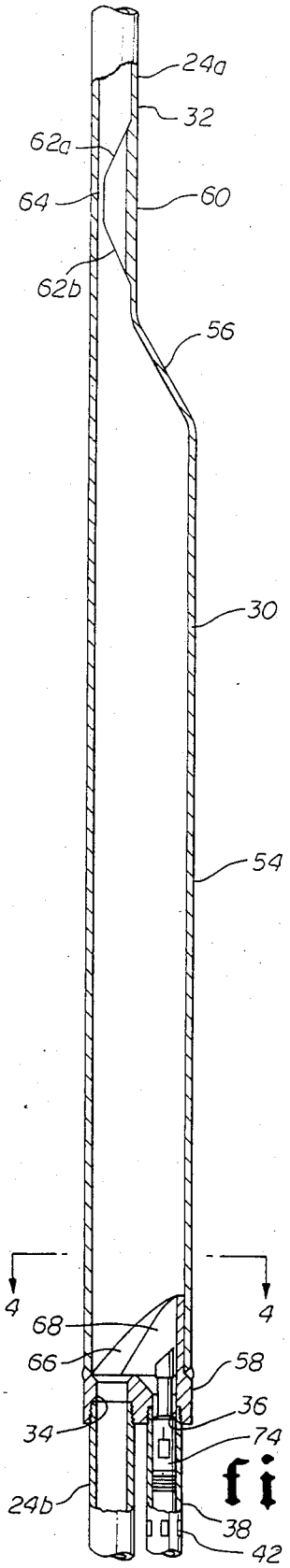
FIGS. 2A, 2B, and 2C are continuation views of the upper, middle, and lower portions, respectively, of the subsurface safety system of the present invention.

Referring now to FIG. 2A, entry mandrel 30 has a preferably tubular main body 54 having an eccentric reducer 56 at one end and a diverter shoe 58 at the other end. Eccentric reducer 56 is threaded at inlet 32 for interconnection with the primary tubing string **24*a* and includes a guide shoe 60. Guide shoe 60 includes upper and lower guide shoulders 62*a* and 62*b*, respectively, which slope toward a key way 64. As will be illustrated in detail hereinafter, guide shoe 60 functions to align well tools having keys in entry mandrel 30** during servicing operations.

Diverter shoe 58 includes threaded primary inlet 34 axially aligned with outlet 32 for interconnection with primary tubing **24*b* and threaded secondary inlet 36 for interconnection with secondary tubing 38. In the preferred embodiment, secondary inlet 36 and secondary tubing 38 have smaller inside diameters than primary inlet 34 and primary tubing 24*b*. Guide shoe 58 includes means for diverting well tools having an effective outside diameter greater than secondary inlet 36 towards primary inlet 34**.

Figure 5:
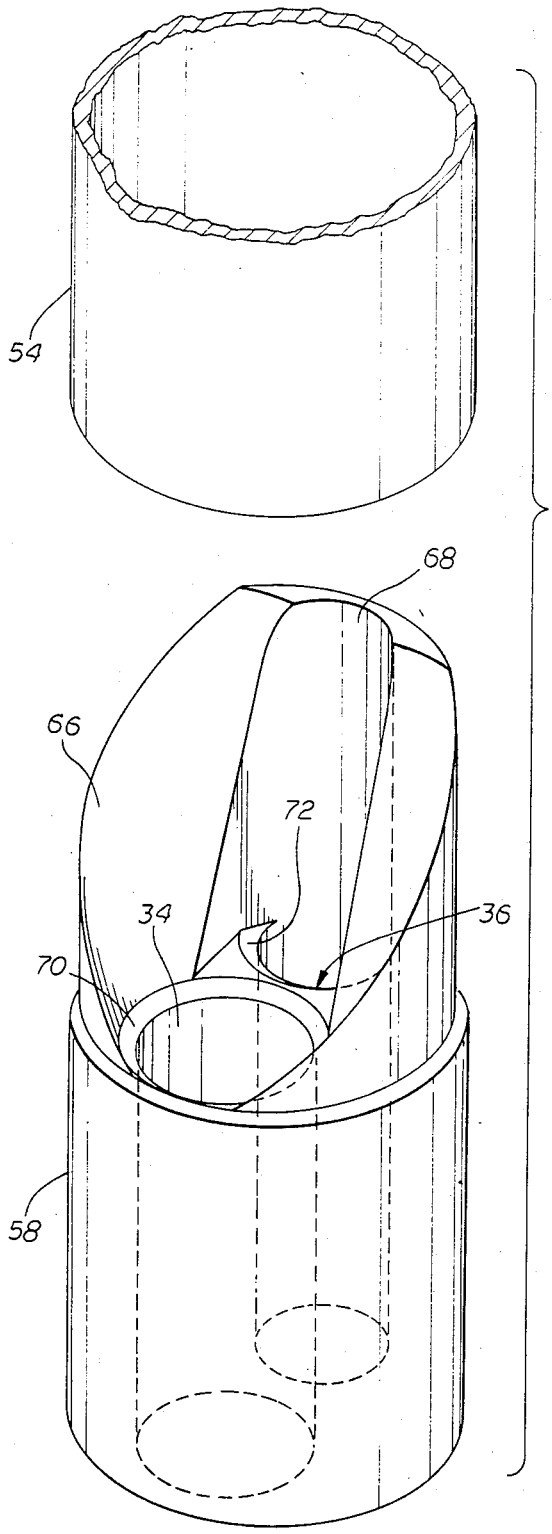
FIG. 5 is an exploded view of the lower portion of the entry mandrel of the present invention showing details of the means for deflecting well tools toward the primary tubing.
Figure 4:
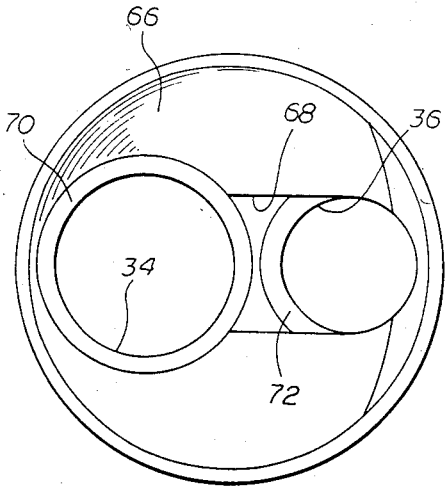
FIG. 4 is a sectional view taken along line 4—4 of FIG. 2A showing the means in the present invention for diverting well tools toward the primary tubing.

Referring now to FIGS. 4 and 5 in connection with FIG. 2A, the diverting means includes a sloping funnel-like upwardly facing surface 66 which substantially surrounds and slopes inwardly toward primary inlet 34. A central slot 68 is formed in surface 66 generally about secondary inlet 36 and opening into primary inlet 34. Slot 68 has a width substantially equal to the inside diameter of secondary inlet 36 thus diverting well tools and the like having an effective outside diameter greater than secondary inlet 36 towards primary inlet 34. However, properly aligned well tools and the like having an effective outside diameter less than secondary inlet 36 can pass through slot 68 and into secondary inlet 36. Inwardly sloping lips 70 and 72 are provided around inlets 34 and 36 respectively.

Referring again to FIG. 2A, secondary inlet 36 and secondary tubing 38 are normally plugged by a removable whipstock plug 74. Whipstock plug 74 is positioned to removably seal secondary tubing 38 above vents 42 and thereby normally prevent communication between entry mandrel 30 and secondary tubing 38. Whipstock plug 74 includes a fishing neck 75 and an upper portion having a sloping upper portion 77 that is orientable to slope towards primary inlet 34.

Figure 2B:
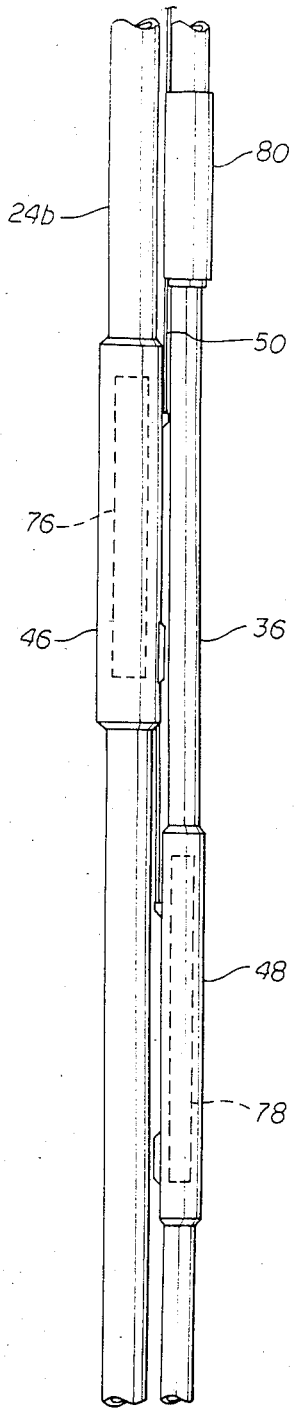

Referring now to FIG. 2B, primary tubing 24*b* includes a tubing retrievable subsurface safety valve 46 and secondary tubing 38 includes a tubing retrievable subsurface safety valve 48. Tubing retrievable subsurface safety valves of the type of valves 46 and 48 are readily available and a preferred valve is the Johnston-Macco TF Surface-Controlled Tubing Retrievable SSSV, as disclosed at page 4999 of the 1982–83 Composite Catalog. Examples of alternative valves of the type of valves 46 and 48 are the Baker Packers FVL or FVH Tubing Retrievable Safety Valves as disclosed at pages 912–913 of the 1982–83 Composite Catalog. The preferred valves are of the flapper type and are controlled from the surface via hydraulic control lines 50.

Subsurface safety valves 46 and 48 may be replaced by wireline retrievable subsurface safety valves designated in phantom in FIG. 2B by the numerals 76 and 78, respectively. The preferred wireline retrievable subsurface safety valves are the Johnston-Macco WF Serviced-Controlled Wireline-Retrievable SSSV as illustrated at page 5000 of the 1982–83 Composite Catalog. Alternatively, the system may include the Baker Packers BFV Wireline Retrievable Safety Valve as shown at pages 938–39 of the 1982–83 Composite Catalog. The system thus offers flexibility in that both the primary tubing 24*b* and secondary tubing 36 may be operated with either tubing retrievable or wireline retrievable subsurface safety valves. Either primary subsurface safety valve 46 or secondary subsurface safety valve 48 may be replaced independently of each other with wireline retrievable subsurface safety valve 76 or 78, respectively. Secondary tubing 36 may include an expansion joint 80 to enable secondary tubing 36 to be connected between entry mandrel 30 and packer 44.

Figure 2C:
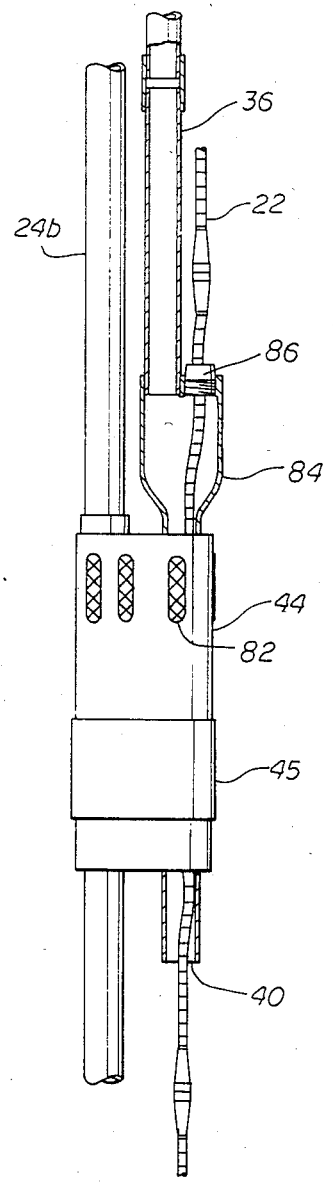

Referring now to FIG. 2C, packer 44 is a standard commercially available dual packer. Packers of the type of packer 44 generally include an expansible packing element 45 for engaging and sealing with the casing and a plurality of slips 82 for gripping the casing. Packer 44 may be either hydraulically or mechanically set.

Secondary tubing 36 includes an exit mandrel 84 which provides access for electrical cable 22 to secondary tubing 36 for penetration of packer 44. A sealing plug electrical connector 86 is provided for establishing the connection between electrical cable 22 and exit mandrel 84. Electrical cable 22 thus enters secondary tubing 36 at exit mandrel 84 above packer 44 and exits secondary tubing 36 at opened end 40 to continue down the hole.

Figure 3A:
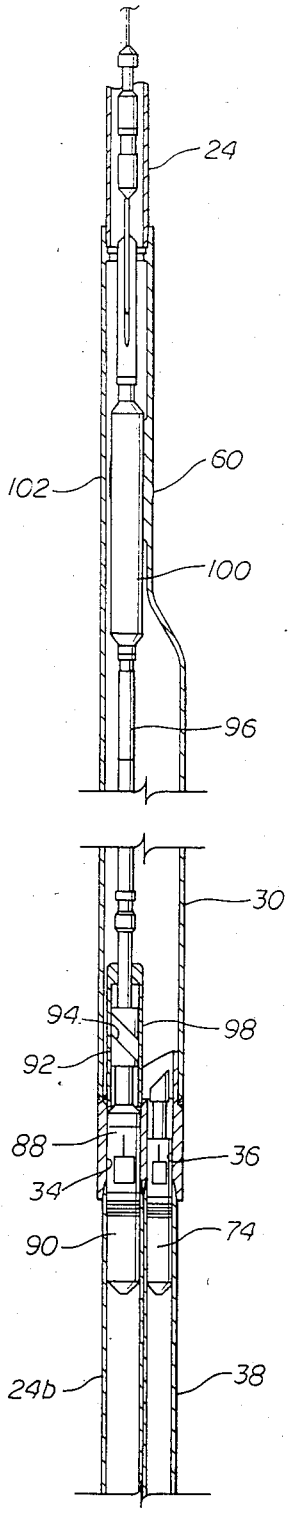
FIGS. 3A, 3B, 3C, 3D, and 3E are sequential views illustrating the method of setting a wireline retrievable subsurface safety valve in the secondary tubing of the present invention.

Referring now to FIGS. 3A–3E, there is illustrated the method of performing wireline operations in secondary tubing 38, as for example, the setting of a wireline retrievable subsurface safety valve therein. Referring first to FIG. 3A, a whipstock plug 88 is set in primary inlet 34 of entry mandrel 30 thereby to plug and block primary tubing 24*b*. Whipstock plug 88 includes a lock plug 90 that is similar to lock plug 74 and an upper end 92 having a sloping upper surface 94. Whipstock plug 88 is set with a running tool 96 having an overshot 98 and an aligning sub 100. Aligning sub 100 includes a key 102 that co-acts with guide shoe 60 to align running tool 96 with in mandrel 30. Whipstock plug 88 is positioned within overshot 98 such that when whipstock plug 88 is set, sloping upper surface 94 slopes toward secondary inlet 36 of entry mandrel 30.

Figure 3B:
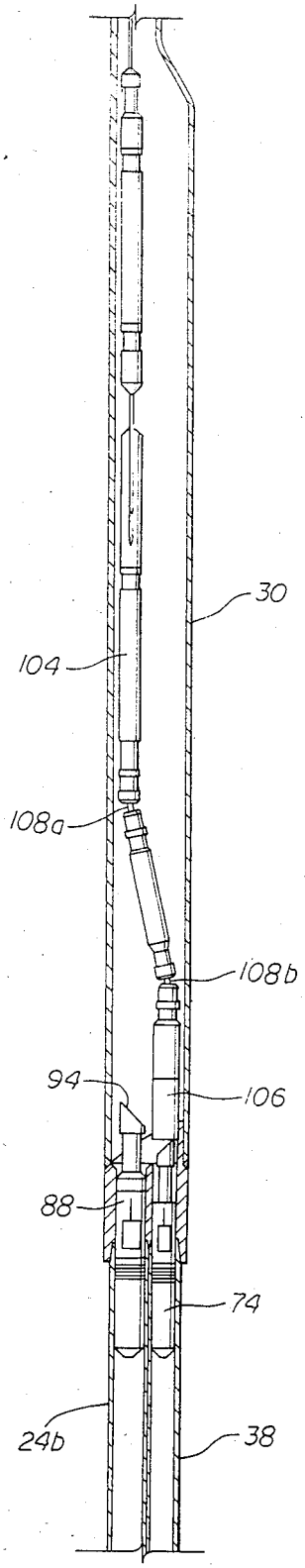

As shown in FIG. 3B, after whipstock plug 88 has been set, a pulling tool 104 is run into entry mandrel 30 to remove whipstock plug 74. Pulling tool 104 includes a overshot 106 and two universally articulated joints 108*a* and 108*b*. Overshot 106 is deflected by upper surface 94 of whipstock plug 88 to enter and engage lock plug 74 to pull lock plug 74 from secondary tubing 38.

Figure 3C:
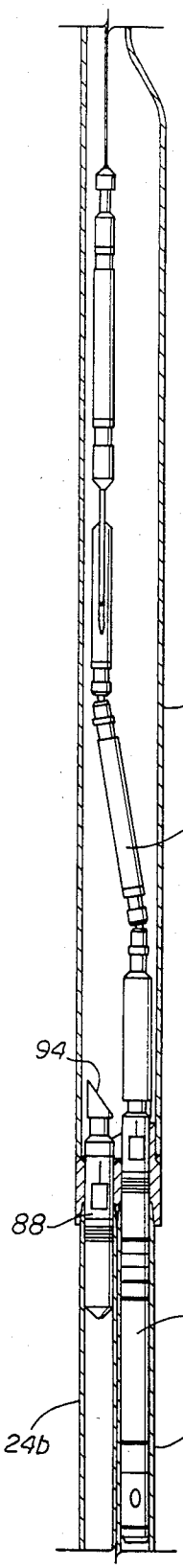

With whipstock plug 74 removed from secondary string 38, and as shown in FIG. 3C, a wireline retrievable subsurface safety valve 78 may be run into secondary string 38. Wireline retrievable subsurface safety valve 78 is run with a dual articulated running tool 110 that is substantially similar to running tool 104. It will be noted that the sloping upper surface 94 of whipstock plug 88 diverts subsurface safety valve 78 positively into secondary tubing 38 without the need for mechanical kick-over devices in running tool 110. The positive diverting feature without the use of kick-over tools enables heavy articles, like wireline retrievable subsurface safety valves, to be moved laterally and manipulated even in high viscosity crude oils and extremely deviated wells.

Figure 3D:
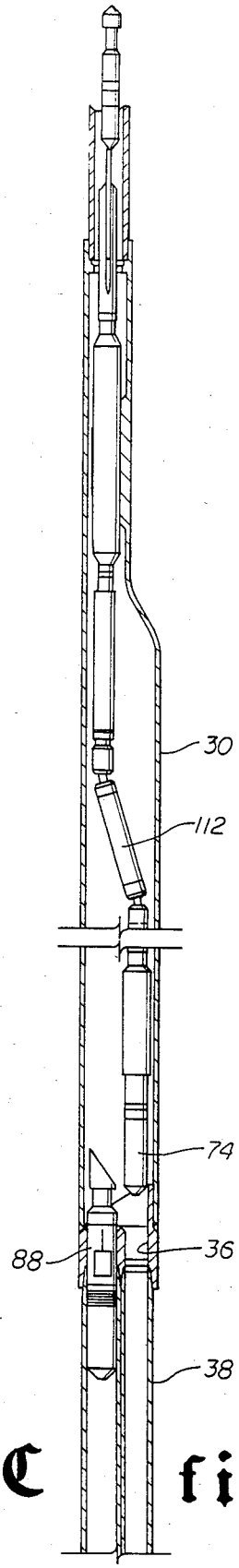
Figure 3E:
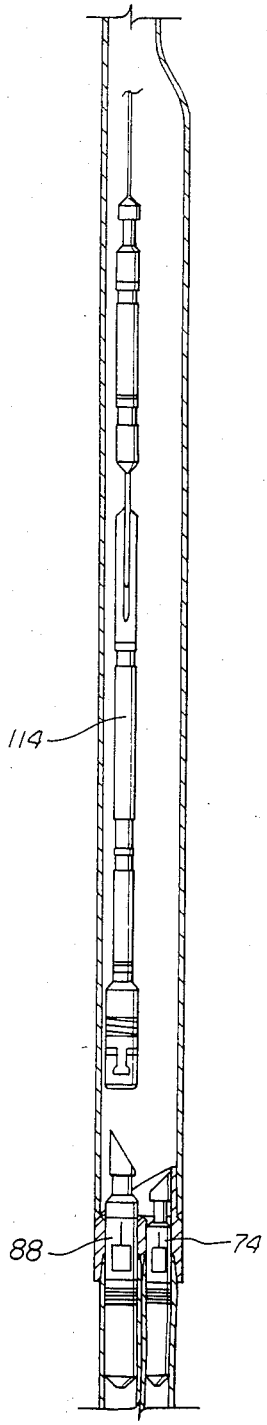

Referring now to FIGS. 3D and 3E, after wireline operations have been completed in secondary string 38, whipstock plug 74 is replaced and whipstock plug 88 is removed, thereby to put the system back into normal operation. Whipstock plug 74 is replaced in secondary inlet 36 by overshot type dual hinged running tool 112, similar to 98 and whipstock plug 88 is removed with an overshot type pulling tool 114 similar to 106.

From the foregoing it will be seen that this invention is one well adapted to attain all of the ends and objects hereinabove set forth together will other advantages which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof it is to be understood that all matters herein set forth as shown in the accompanying drawings are to be interpreted as illustrative and not in a limiting sense.

What is claimed is:

1. A method of inserting a tubular valve into the secondary bore of a mandrel having a main bore and a laterally offset secondary bore, which comprises the steps of:

positioning a whipstock plug in said main bore, said whipstock plug having a sloping upper surface;

orienting said whipstock plug such that said upper surface slopes toward said secondary bore;

deflecting said tubular valve off said upper surface to place said tubular valve into said secondary bore;

and removing said whipstock plug from said main bore after said tubular valve is placed in said secondary bore.

2. The method as claimed in claim 1, wherein said positioning step includes the step of:

running said whipstock plug into said mandrel with an unarticulated running tool.

3. The method as claimed in claim 1, wherein said placing step includes the steps of:

running said tubular valve into said mandrel with an articulated running tool.

4. A method of removing a tubular valve from the secondary bore of a mandrel having a main bore and a laterally offset secondary bore, which comprises the steps of:

positioning a whipstock plug in said main bore, said whipstock plug having a sloping upper surface;

orienting said whipstock plug such that said upper surface slopes toward said secondary bore;

deflecting a retrieving tool off said upper surface to engage said tubular valve;

removing said tubular valve from said secondary bore;

and removing said whipstock plug from said main bore after removal of said tubular valve from said secondary bore.

* * * * *